US012169120B2

(12) United States Patent
Lämmle et al.

(10) Patent No.: US 12,169,120 B2
(45) Date of Patent: Dec. 17, 2024

(54) WEAPON HAVING A DEFLAGRATION IGNITER AND METHOD FOR OPERATING SUCH A WEAPON

(71) Applicants: ATLAS ELEKTRONIK GMBH, Bremen (DE); thyssenkrupp AG, Essen (DE)

(72) Inventors: Knud Lämmle, Hamburg (DE); Sönke Huckfeldt, Elmshorn (DE)

(73) Assignees: ATLAS ELEKTRONIK GMBH, Bremen (DE); thyssenkrupp AG, Essen (DE)

( * ) Notice: Subject to any disclaimer, the term of this patent is extended or adjusted under 35 U.S.C. 154(b) by 539 days.

(21) Appl. No.: 17/420,031

(22) PCT Filed: Jan. 17, 2020

(86) PCT No.: PCT/EP2020/051105
§ 371 (c)(1),
(2) Date: Jun. 30, 2021

(87) PCT Pub. No.: WO2020/156833
PCT Pub. Date: Aug. 6, 2020

(65) Prior Publication Data

US 2022/0090886 A1 Mar. 24, 2022

(30) Foreign Application Priority Data

Jan. 30, 2019 (DE) ..... 10 2019 201 176.4

(51) Int. Cl.
*F42B 39/20* (2006.01)
*F42B 3/10* (2006.01)
(Continued)

(52) U.S. Cl.
CPC ..... *F42B 3/22* (2013.01); *F42B 3/10* (2013.01); *F42B 39/20* (2013.01); *F42C 9/00* (2013.01); *F42C 9/16* (2013.01); *F42C 19/0842* (2013.01)

(58) Field of Classification Search
CPC ..... F41C 9/16; F41C 19/0842
See application file for complete search history.

(56) References Cited

U.S. PATENT DOCUMENTS 8,371,224 B1 * 2/2013 Boswell ..... F42C 19/0846 102/305
9,273,939 B2 * 3/2016 Ackermann ..... F42C 15/00
(Continued)

FOREIGN PATENT DOCUMENTS

DE 3704668 C2 * 8/1991
DE 100 18 285 A 10/2001
(Continued)

OTHER PUBLICATIONS

Machine Translation of EP 1338861 A1. Renaud. <https://worldwide.espacenet.com/>. Aug. 27, 2003. (Year: 2003).*
(Continued)

*Primary Examiner* — Gabriel J. Klein
(74) *Attorney, Agent, or Firm* — thyssenkrupp North America, LLC

(57) ABSTRACT

A weapon may comprise an explosive charge, an activatable detonation ignition means, an activatable deflagration ignition means, and an ignition device. The ignition device can activate, selectively, the detonation ignition means or the deflagration ignition means. The activated detonation ignition means can cause the explosive charge to detonate. The activated deflagration ignition means can cause the explosive charge to deflagrate. According to one method, the ignition device activates the detonation ignition means, which causes the explosive charge to detonate. If a prede-
(Continued)

termined event takes place without the explosive charge detonating, the ignition device activates the deflagration ignition means, which causes the explosive charge to deflagrate.

15 Claims, 4 Drawing Sheets

(51) Int. Cl.

| | |
|---|---|
| ***F42B 3/22*** | (2006.01) |
| ***F42C 9/00*** | (2006.01) |
| ***F42C 9/16*** | (2006.01) |
| ***F42C 19/08*** | (2006.01) |

(56) References Cited

U.S. PATENT DOCUMENTS

| | | | | |
|---|---|---|---|---|
| 10,228,226 | B2 | 3/2019 | Florian | |
| 10,648,785 | B1 * | 5/2020 | Lucas | F42D 5/04 |
| 2004/0069176 | A1 | 4/2004 | Kellner | |
| 2006/0225599 | A1 * | 10/2006 | Brunet | C06B 23/001 102/473 |
| 2011/0203475 | A1 * | 8/2011 | Thuman | F42C 15/36 102/275.11 |
| 2012/0227609 | A1 * | 9/2012 | Volkmann | F42C 19/0842 102/202.7 |
| 2013/0239837 | A1 * | 9/2013 | Ames | F42B 12/22 102/478 |
| 2017/0184385 | A1 * | 6/2017 | Florian | F42C 19/095 |

FOREIGN PATENT DOCUMENTS

| | | | | |
|---|---|---|---|---|
| DE | 101 25 079 | C | 1/2003 | |
| DE | 10227002 | B | 6/2005 | |
| DE | 102009017160 | B | 8/2010 | |
| DE | 102014004003 | B | 10/2014 | |
| DE | 102014003893 | A | 9/2015 | |
| DE | 102015010855 | A | 2/2017 | |
| EP | 1338861 | A1 * | 8/2003 | F42C 9/14 |
| EP | 2 789 965 | A | 10/2014 | |
| EP | 2789965 | A1 * | 10/2014 | F42C 19/0842 |
| EP | 2789964 | B1 * | 7/2015 | F42C 19/0842 |
| WO | 2004/003460 | A | 1/2004 | |

OTHER PUBLICATIONS

English Translation of International Search Report issued in PCT/EP2020/051105, dated Apr. 24, 2020.

Annex 1 of Section 1(1) (War Weapons List) of the German War Weapons Control Act (Kriegswaffenkontrollgesetz) (Dec. 19, 1994) pp. 14-21.

* cited by examiner

WEAPON HAVING A DEFLAGRATION IGNITER AND METHOD FOR OPERATING SUCH A WEAPON

CROSS REFERENCE TO RELATED APPLICATIONS

This application is a U.S. National Stage Entry of International Patent Application Serial Number PCT/EP2020/051105, filed Jan. 17, 2020, which claims priority to German Patent Application No. DE 10 2019 201 176.4, filed Jan. 30, 2019, the entire contents of both of which are incorporated herein by reference.

FIELD

The present disclosure generally relates to weapons and methods of operating weapons, including weapons having explosive charge and detonation ignition means.

BACKGROUND

The invention relates to a weapon having an explosive charge and a detonation ignition means and to a method for operating a weapon of this kind.

A weapon, for example a torpedo or a naval mine, comprises an explosive charge, for example a warhead. A detonation ignition means, in particular a detonation ignition chain, can be activated, usually following safety release and upon receipt of a corresponding activation command. The activated detonation ignition means causes the explosive charge to detonate.

The situation may arise whereby the explosive charge cannot be detonated due to a technical fault, for example, or is not allowed to be detonated on account of a possible unintentional danger to life and/or property. In both cases, the weapon must be reliably neutralized without it posing any danger to life or property.

Thus, a need exists for a weapon that can be neutralized relatively harmlessly when the explosive charge cannot, or may not, be detonated.

DETAILED DESCRIPTION

Figure 1:
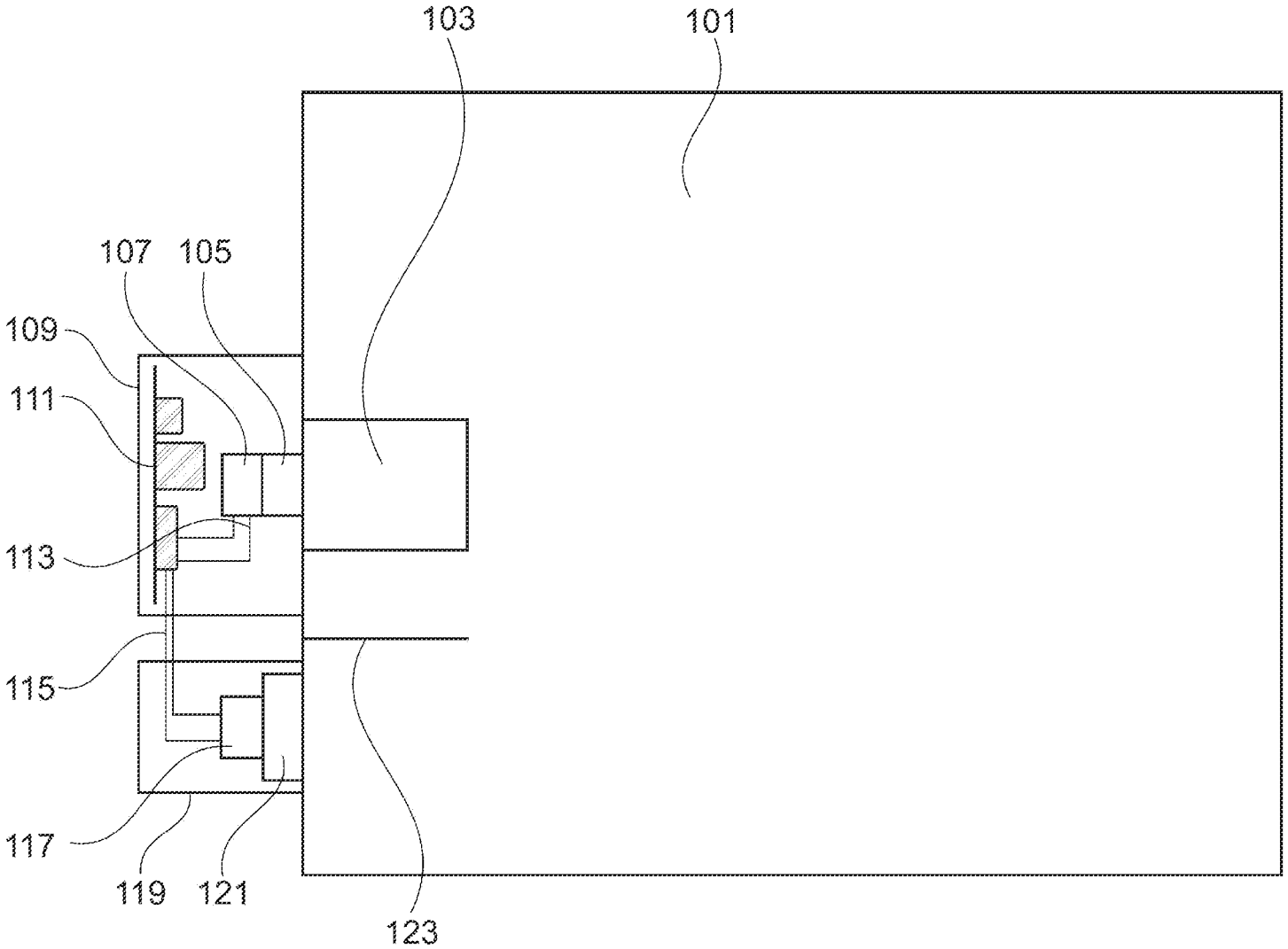
FIG. 1 is a schematic view of an example weapon with a main explosive charge, a detonation ignition chain, and a spatially completely separate deflagration ignition chain.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The weapon according to the solution comprises an explosive charge, an activatable detonation ignition means, an activatable deflagration ignition means, and an ignition device.

The ignition device is able to activate, selectively, the detonation ignition means or the deflagration ignition means. The activated detonation ignition means is able to cause the explosive charge to detonate. The activated deflagration ignition means is able to cause the same explosive charge to deflagrate.

A weapon of this kind can be operated by the method according to the solution. The method comprises the following steps:

Upon receipt of a detonation activation command, the ignition device activates the detonation ignition means.

The activated detonation ignition means causes the explosive charge to detonate.

If a predetermined event takes place without the explosive charge having been previously detonated, the following steps are implemented:

The ignition device activates the deflagration ignition means.

The activated deflagration ignition means causes the explosive charge to deflagrate.

"Deflagration" refers to the process whereby the explosive charge burns without detonating. The burning takes place at a speed which is slower than the speed of sound in the explosive charge. The detonation ignition means usually produces pressure waves which act on the explosive charge and cause it to detonate. The deflagration ignition means essentially produces heat which acts on the explosive charge and causes it to deflaarate.

The invention achieves a substantial advantage, in particular when the explosive charge cannot be detonated due to a technical fault, for example, or is not allowed to be detonated due to a possible unintentional danger to life and/or property. In many cases the invention avoids the need for the weapon to be moved to a safe location and for the explosive charge to be detonated there. Transporting the weapon, in particular, can be costly and hazardous. This expense and risk have been well enough known to date due to the neutralization (deactivation) of unexploded ordinance from the last World War.

Thanks to the invention, it is possible to guarantee that the explosive charge is destroyed, and therefore neutralized, by a planned detonation or a selectively initiated deflagration. This means that even if the explosive charge is not detonated, it is prevented from falling into the hands of unauthorized persons. These unauthorized persons could accidentally (e.g. children at play or reckless adults) or deliberately (e.g. criminals) use the explosive charge in such a way as to endanger life.

In many cases the deflagration of the explosive charge that has been caused means that due to the resulting combustion gases and/or flames, the electronic devices, in particular the data stores, on board the weapon, are destroyed. This means that unauthorized persons who come into possession of the remnants of the defiagrated weapon are prevented from obtaining confidential information by inspecting or evaluating the electronic devices. In particular, in many cases a data store is prevented from being read out without authorization or an inscription from being read.

The invention saves the need for a further explosive charge or other device to be provided on board the weapon, in order to destroy an electronic device on board said weapon, in addition to the explosive charge which can either be caused to detonate or deflagrate. The deflagration ignition means does not necessarily include an explosive charge. Because there is no need for an additional explosive charge, the invention saves on an additional component and therefore on installation space. During the deflagration of the explosive charge, a large amount of energy, in particular chemical energy, is released, which is able to destroy all electronic devices with a far greater degree of reliability than a further explosive charge or another separate destructive device.

The weapon customarily comprises a safety release mechanism. This safety release mechanism must be initially released. Following the release, it is possible for an activation command to be triggered which activates the detonation ignition means. The weapon according to the solution is also preferably implemented with a safety release mechanism of this kind.

In one embodiment, the weapon comprises at least one electronic device and a guidance device. During deflagration of the explosive charge, combustion gases and/or flames are produced. The guidance device guides these combustion gases and/or flames in the direction of the, or at least one, preferably each electronic device. The combustion gases and/or flames which are guided destroy the, or each, electronic device of the weapon selectively and with even greater reliability than would be the case without the guidance device. This means that a person who comes into possession of the remnants of the deflagrated weapon is unable to evaluate or use the, or an, electronic device belonging to the weapon in an unauthorized manner.

The guidance device may be configured as a purely mechanical and passive device and therefore be very reliable and require no drive and no monitoring.

Thanks to the guidance device, the need for a dedicated destruction mechanism to be provided for the electronic device is avoided. This dedicated destruction mechanism can fail or, however, be unintentionally activated and destroy the electronic device. On the other hand, the combustion gases and/or flames that inevitably result during a deflagration of the explosive charge destroy the electronic device with a greater degree of reliability, thanks to the substantially greater amount of energy released, than would a dedicated destruction mechanism for the electronic device. The guidance device conducts the combustion gases and/or flames to the, or each, device.

The guidance device which conducts the combustion gases and/or flames may be a special mechanical component of the weapon. In another embodiment, a component of a housing of the weapon becomes this guidance device during the deflagration. The housing comprises a first housing part and a second housing part. These two housing parts are connected to one another in a connection part which is configured as a predetermined breaking point between the two housing parts. A deflagration of the explosive charge produces excess pressure in the housing. In particular, this excess pressure which is produced leads to this connection part configured as a predetermined breaking point breaking. Once the predetermined breaking point has broken, the first housing part is movable relative to the second housing part. As soon as the first housing part is movable, the combustion gases and/or the flames which occur during deflagration and the excess pressure caused mean that the first housing part actually moves away from the second housing part. This produces a sufficiently large opening in the housing, and the second housing part acts as a component of the guidance device for the combustion gases and/or flames.

In one embodiment, the deflagration ignition means is spatially separate from the detonation ignition means. A mechanical barrier is preferably arranged between the deflagration ignition means and the detonation ignition means, namely permanently or at least until the ignition device activates the detonation ignition means. Once the deflagration ignition means is activated, this mechanical barrier reduces the risk of the detonation ignition means being activated and/or pressure waves from the deflagration ignition means reaching a component of the detonation ignition means, e.g. an ignition amplifier charge, and possibly triggering a detonation. The mechanical barrier therefore reduces the risk of the explosive charge being unintentionally detonated when the deflagration ignition means is activated. The mechanical barrier can be configured as a purely passive component and does not therefore need to be activated. The mechanical barrier can be designed as a fixed component which does not require a drive or can be moved from a deflagration position into a detonation position.

In another embodiment, at least one component of the weapon belongs both to the detonation ignition means and to the deflagration ignition means. This joint component can preferably be activated by the ignition device. This embodiment reduces the number of components required for the two ignition means.

In a development of this embodiment, this common component can be operated, selectively, in detonation mode or in deflagration mode. In detonation mode the common component contributes to the detonation of the explosive charge. In deflagration mode the common component contributes to the deflagration of the explosive charge. For example, this common component can be selectively activated in such a manner that it either achieves the maximum possible effect, for example pressure waves with the maximum possible pressure, or only a lesser effect, for example essentially heat and no pressure waves, or pressure waves with a substantially lower amplitude. In detonation mode the common component produces the maximum possible effect; in deflagration mode, only the, or a, lesser effect.

It is also possible for the common component to be moved, for example linearly displaced or pivoted, either into a deflagration position or into a detonation position. The common component in the deflagration position belongs to the deflagration ignition means, while the common component in the detonation position belongs to the detonation ignition means. A suitable element, for example a locking unit, preferably holds the common component in the deflagration position and prevents the common component from being unintentionally moved into the detonation position. This embodiment further reduces the risk of the explosive charge being unintentionally detonated. An actuator is able to move the common component into the detonation position, for example in that the actuator unlocks the locking unit and preferably following a safety release. It is also possible for the common component to be held in a standby position and later moved either into the detonation position or into the deflagration position.

It is possible for the weapon to comprise a single ignition means which acts both as the detonation ignition means and as the deflagration ignition means. This single ignition means can be operated as a whole, selectively, in a detonation mode or in a deflagration mode or it can be moved, selectively, into a deflagration position or into a detonation position. In this embodiment the ignition device is also able to activate this single ignition means.

An embodiment with two different modes for the common component can be combined with an embodiment with two different positions for the same common component. This combination further increases the certainty that the explosive charge will not be detonated unintentionally.

In another development of the embodiment with the common component, a further component of the weapon belongs only to the detonation ignition means, and not to the deflagration ignition means. If both the common component and the further component are activated, these two activated components contribute to the explosive charge being detonated. If only the common component is activated, but not the further component, the explosive charge is caused to deflagrate.

For example, the explosive charge is caused to detonate when the common component and the further component are activated according to a predefined temporal flow chart, for example simultaneously or, to be more precise, so that the two activation times for the two components differ from one another by a predefined tolerance interval at most. The explosive charge is caused to deflagrate when the common component is activated.

It is possible for an actuable switch to be arranged between the ignition device and the further component. Depending on the position of this switch, the ignition device is able to activate the further component, in addition to the common component, or the further component is locked by the switch or a separate barrier to prevent activation.

Both the detonation ignition means and the deflagration ignition means are preferably each configured as an ignition chain comprising multiple components or realized by a single ignition chain with multiple components. The ignition device activates a first component, and a component of this ignition chain in each case activates the following component. The last component of the ignition chain in each case causes the explosive charge to detonate or deflagrate. The deflagration ignition means preferably comprises an ignition initiator charge and a subsequent deflagration charge.

In one embodiment the weapon is abandoned, for example moved into the water. According to the solution, the ignition device of the abandoned weapon activates the deflagration ignition means when a predetermined event has taken place. In one embodiment, this event takes place when a deflagration activation command has been sent to the weapon. In another embodiment, this event will have taken place when, following the event whereby the weapon is abandoned, a predetermined interval has elapsed without the explosive charge being detonated. Once this interval has elapsed, the ignition device automatically activates the deflagration ignition means.

The embodiment with the interval of time ensures that the weapon is neutralized automatically and independently by the deflagration which is automatically triggered. This desired neutralization also takes place when a data connection to the weapon cannot be established and it is not therefore possible to transmit an activation command to the weapon and, at the same time, to ensure that no other weapon has been activated. Also, in the event that the data connection is not possible or has been lost or interrupted, this embodiment ensures that the weapon no longer poses a risk once the interval of time has elapsed.

The two embodiments can be combined with one another. The ignition device activates the deflagration ignition means when the weapon has received a deflagration activation command or when the predetermined interval of time has elapsed. This combination further increases the certainty that the weapon has been caused to deflagrate in each case and no longer poses a risk, at the latest once the interval of time has elapsed.

In one embodiment, the weapon is designed for underwater deployment, for example as an underwater projectile, e.g. as a torpedo, or as a naval mine or a sweeping device for neutralizing naval mines. The weapon may also be a guided missile (e.g. a rocket) or an unguided missile (e.g. an aircraft bomb) or an anti-tank weapon or a grenade or a land mine. A weapon within the meaning of the patent claims may be any weapon that has an explosive charge and/or is referred to in Annex 1 of Section 1(1) (War Weapons List) of the German War Weapons Control Act (Kriegswaffenkontrollgesetz).

The invention can be realized on board a weapon, in order to ensure that the weapon is neutralized by deflagration if the explosive charge does not detonate after the weapon has been abandoned, for example due to a technical fault, or if a carrier vehicle drops the weapon without it being intended to detonate. The second situation arises, for example, when an airplane or another aircraft carries the weapon on board and has to eject it prior to landing, so that the weight of the aircraft remains below a prescribed weight limit when it touches down on a landing strip.

In the exemplary embodiment, the invention is used for a weapon in the form of an underwater projectile, e.g. a torpedo, or a guided or unguided missile. This weapon comprises a main explosive charge 101 which is configured in such a manner that it is not accidentally detonated by a vibration, in particular not while the weapon is being transported to a deployment site. An ignition means is therefore needed which is able to bring about an intentional detonation of the main explosive charge 101. According to the solution, the weapon further comprises an ignition means which is able to bring about a deflagration of the main explosive charge 101. The main explosive charge 101 burns away during a deflagration, wherein flames and combustion gases are usually produced without the main explosive charge 101 being detonated.

The following further components of this weapon are shown schematically in FIG. 1:

- a detonation ignition means in the form of a detonation ignition chain 109 which is able to cause detonation of the main explosive charge 101,
- a deflagration ignition means in the form of a deflagration ignition chain 119 which is able to cause deflagration of the main explosive charge 101, in which the main explosive charge 101 burns away without being detonated,
- an ignition device in the form of an igniter electronic system 111 which is configured as an electronic component on a printed circuit board, and a passive mechanical barrier 123 between the detonation ignition chain 109 and the deflagration ignition chain 119.

The detonation ignition chain 109 comprises an ignition initiator charge (detonator) 107, a stage-1 ignition amplifier charge with the reference number 105, and a stage-2 ignition amplifier charge with the reference number 103, The deflagration ignition chain 119 comprises an ignition initiator charge (deflagrator) 117 and a deflagration charge 121.

The igniter electronic system 111 is able to trigger the detonation ignition chain 109 or the deflagration ignition chain 119 selectively. If the safety release mechanism has been actuated and the release has been effected and the igniter electronic system 111 then receives a detonation activation command and subsequently triggers the detonation ignition chain 109, the following steps are implemented:

The igniter electronic system 111 activates the ignition initiator charge (detonator) 107.

The activated detonator 107 activates the stage-1 ignition amplifier charge 105.

The activated stage-1 ignition amplifier charge 105 activates the stage-2 ignition amplifier charge 103.

The activated stage-2 ignition amplifier charge 103 causes the main explosive charge 101 to detonate.

In one embodiment, a movable metal plate which is not shown prevents the stage-2 ignition amplifier charge 103 from being unintentionally activated. This metal plate interrupts the detonation ignition chain 109. An actuator which is not shown pulls this metal plate to the side as soon as the detonation activation command has been received, as a result of which the detonation ignition chain 109 is closed. This actuator, which is able to pull the metal plate to the side, preferably belongs to the safety release mechanism in the exemplary embodiment. Only when this safety release mechanism has been actuated can the detonation activation command cause the detonation ignition chain 109 to be closed.

If the igniter electronic system 111 receives a deflagration activation command and actuates the deflagration ignition chain 119 as a result of this or for another reason (see below), the following steps are performed:

The igniter electronic system 111 activates the ignition initiator charge (deflagrator) 117.

The activated deflagrator 117 activates the deflagration charge 121.

The activated deflagration charge 121 causes the main explosive charge 101 to deflagrate.

The deflagration ignition chain 119 may also comprise a movable metal plate which prevents the deflagration charge 121 from being unintentionally activated and which is part of the safety release mechanism.

The activated deflagration charge 121 produces an adequately high temperature, at least on the side facing the main explosive charge 101. This adequately high temperature causes a deflagration of the main explosive charge 101. An unintentional and therefore unwanted detonation of the main explosive charge 101 is prevented in the exemplary embodiment by the following measures:

The impulse (the pressure wave) which is produced during activation of the deflagration charge 121 is kept low, The main explosive charge 101 is only detonated when pressure waves with a sufficiently large impulse occur.

The stage-2 ignition amplifier charge 103 has a more sensitive reaction to impulse waves than the main explosive charge 101. The mechanical barrier 123 prevents an unintentional activation of the stage-2 ignition amplifier charge 103.

In the exemplary embodiment, the weapon is abandoned, for example launched or dropped. A timer switch on board the weapon is activated. As soon as the igniter electronic system 111 receives a detonation activation command, the igniter electronic system 111 activates the detonation ignition chain 109, as a result of which the main explosive charge 101 is caused to detonate. The igniter electronic system 111 automatically activates the deflagration ignition chain 119 when one of the following events has taken place:

A deflagration activation command has been sent to the weapon.

After the timer switch has been started, a predetermined interval has elapsed without the main explosive charge 101 having been caused to detonate or deflagrate, i.e. the igniter electronic system 111 is still intact.

Figure 2:
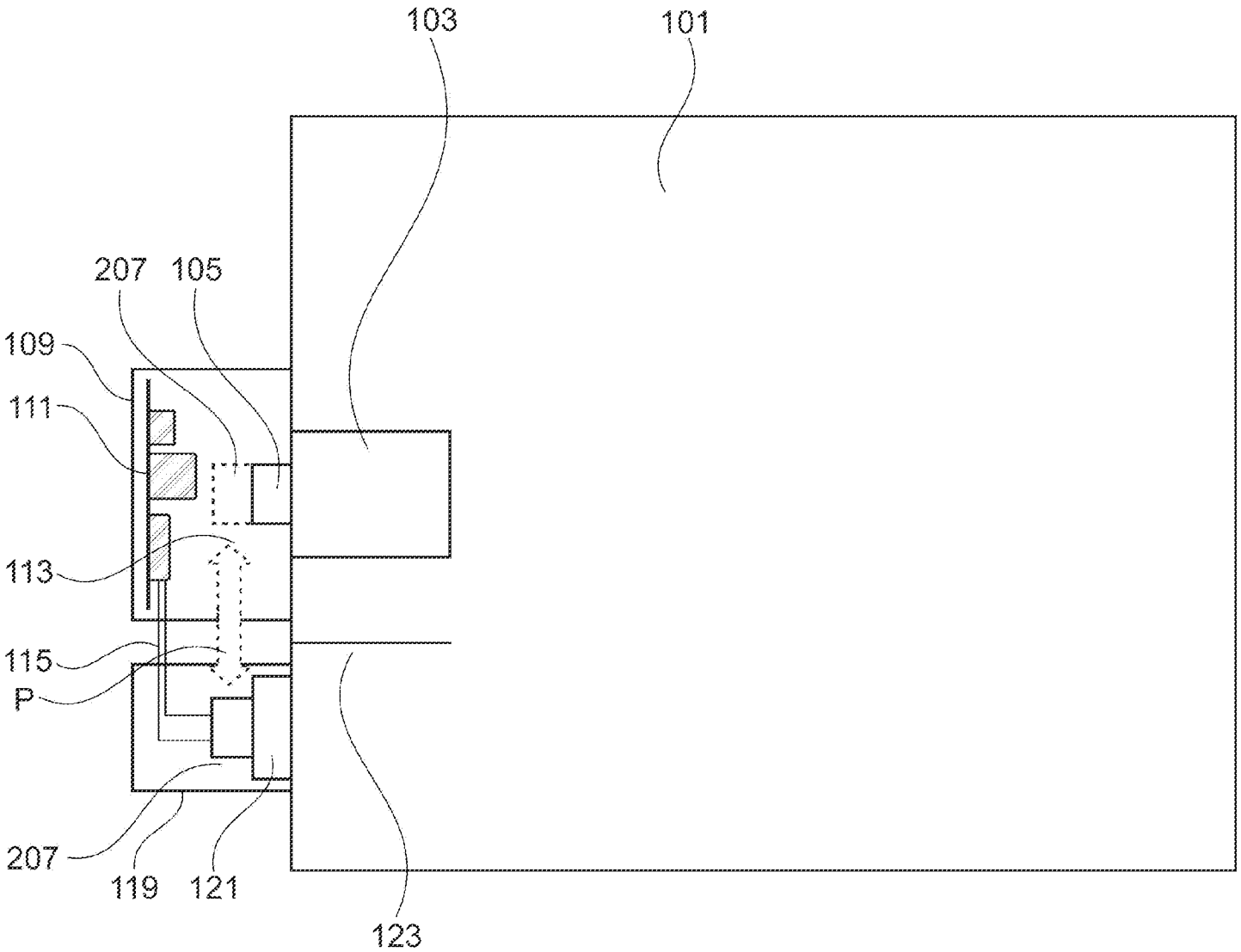
FIG. 2 is a schematic view of a variant of the example shown in FIG. 1, wherein the same ignition initiator charge belongs to the detonation ignition chain or the deflagration ignition chain, depending on position.

FIG. 2 shows a modification of the embodiment in FIG. 1. Instead of an ignition initiator charge 107 of the detonation ignition chain 109 and a spatially separate ignition initiator charge of the deflagration ignition chain 119, this modification comprises a single ignition initiator charge 207 which is movably arranged, for example can be turned or displaced linearly. This ignition initiator charge 207 can therefore be moved back and forth between a detonation position and a deflagration position, which is indicated by the double arrow P. The detonation position is shown by a dotted line in FIG. 2 and the deflagration position by a continuous line. An actuator which is not shown is able to move the ignition initiator charge 207 back and forth between these two positions. The ignition initiator charge 207 is preferably held in the deflagration position, for example locked there.

In a further implementation, the ignition initiator charge 207 is initially held in a standby position in which it is spatially remote from the ignition amplifier charge 105 and spatially remote from the deflagration charge 121. The actuator which is not shown is able to move the ignition initiator charge 207 out of the standby position into the detonation position or into the deflagration position, selectively.

In the detonation position, the ignition initiator charge 207 is connected to the stage-1 ignition amplifier charge 105; in the deflagration position it is connected to the deflagration charge 121. After receiving a corresponding activation command, the igniter electronic system 111 activates the ignition initiator charge 207. Depending on its position, the ignition initiator charge 207 belongs to the detonation ignition chain 109 or to the deflagration ignition chain 119 and triggers a detonation or deflagration of the main explosive charge 101.

Figure 3:
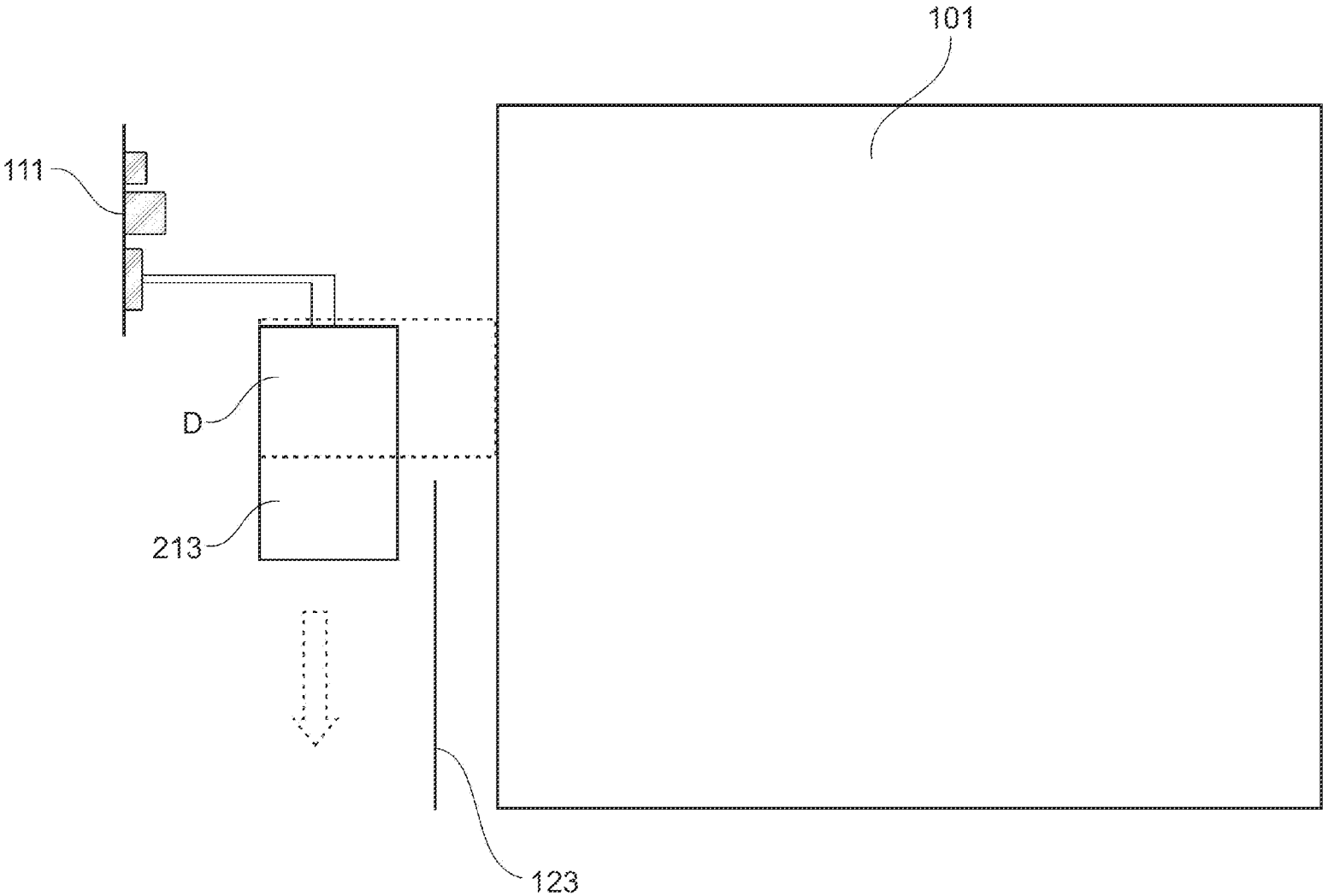
FIG. 3 is a schematic view of another variant of the example shown in FIG. 1, wherein the entire ignition chain is arranged rotatably and as a detonation ignition chain or as a deflagration ignition chain, depending on position.

FIG. 3 shows schematically a further modification. In this further modification, an ignition means 213 is rotatably mounted as a whole, namely about a rotational axis D and, for example, about 90 degrees. This rotatably mounted ignition means 213 replaces the detonation ignition chain 109 and the deflagration ignition chain 119 from FIG. 1 and FIG. 2 and may likewise be configured as an ignition chain. In FIG. 3 the ignition means 213 is shown in a detonation position using a dotted line and in a deflagration position using a continuous line.

After receiving an activation command, the igniter electronic system 111 activates this ignition means 213. The activated ignition means 213 produces pressure waves and heat. If the ignition means 213 is in the detonation position, the pressure waves reach the main explosive charge 101 and cause it to detonate. If the ignition means 213 is in the deflagration position, on the other hand, the orientation of the ignition means 213 and the mechanical barrier 123 prevent pressure waves from the activated ignition means 213 from reaching the main explosive charge 101, in such a manner that the pressure waves cause the main explosive charge 101 to detonate. It is essentially only the heat that reaches the main explosive charge 101 and causes it to deflagrate. It is possible that before the ignition means 213 turns out of the deflagration position into the detonation position, the mechanical barrier 213 is retracted, in order to allow movement and to ensure that pressure waves actually reach the main explosive charge 101 and bring about the desired detonation. It is possible that this ignition means 213 can, in addition, be selectively activated in a detonation mode or in a deflagration mode.

FIG. 4*a*) shows by way of example a weapon in the form of a missile 205 in which the invention is implemented. This missile 205 comprises a rear housing part 209 and a front housing part 211 which has a smaller dimension than the rear housing part 209 in the longitudinal direction of the missile 205. A mechanical connection part 203 between the two housing parts 211 and 209 is configured as a predetermined breaking point. The rear housing part 209 includes the main explosive charge 101, the detonation ignition chain 109, the deflagration ignition chain 119, and control electronics system 201 with the igniter electronics system 111. The control electronics system 201 is arranged between the main explosive charge 101 and the front housing part 211.

Figure 4:
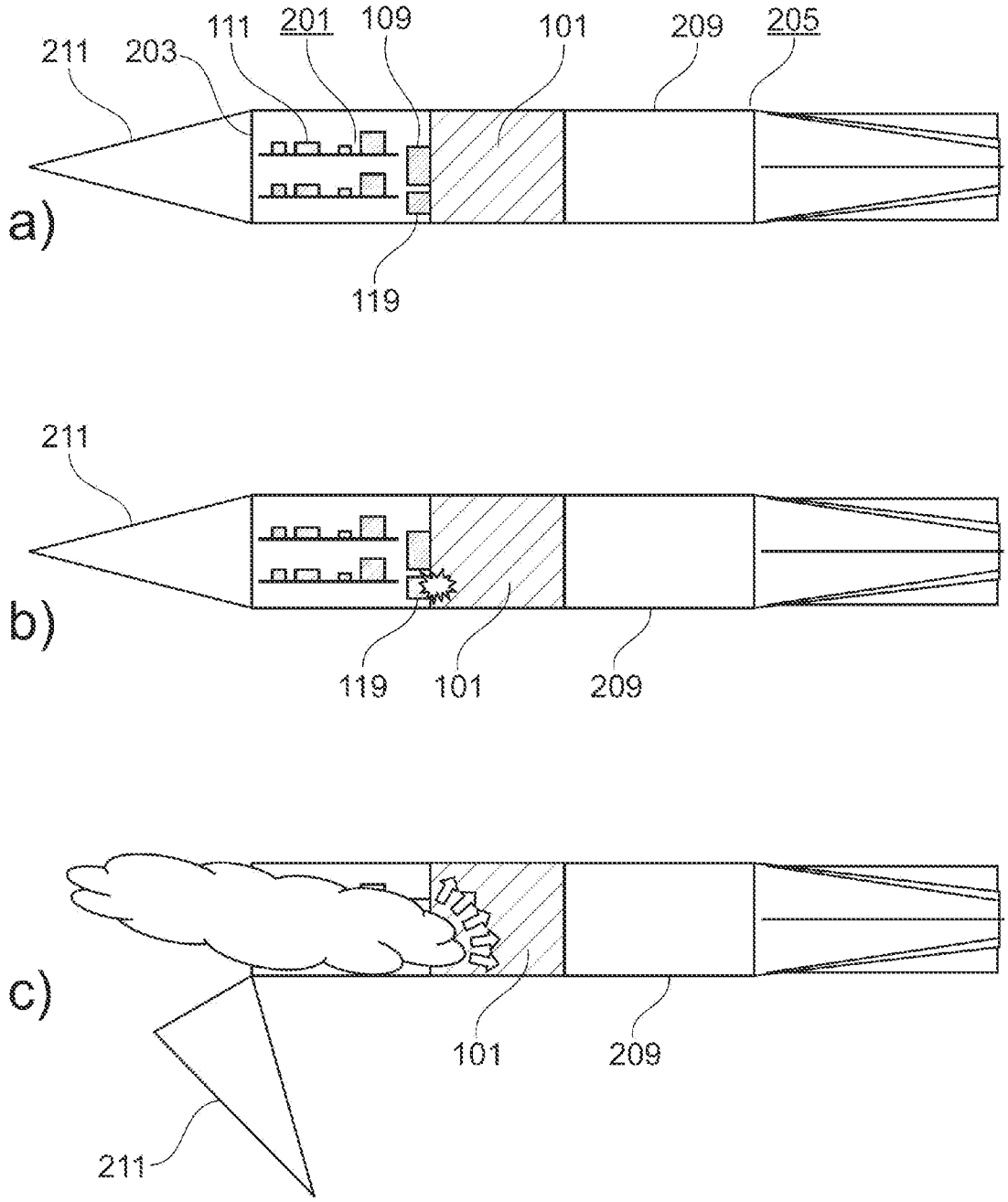
FIG. 4*a* is a schematic view representing a first sequence step of intentionally destroying an entire control electronics system onboard a weapon.
FIG. 4*b* is a schematic view representing a second sequence step of intentionally destroying an entire control electronics system onboard a weapon.
FIG. 4*c* is a schematic view representing a third sequence step of intentionally destroying an entire control electronics system onboard a weapon.

In the situation shown in FIG. 4 b) the deflagration ignition chain 119 has been activated. The main explosive charge 101 is thereby caused to deflagrate, which is indicated in FIG. 4*c*).

During deflagration, the control electronics system 201 of the missile 205 should also be completely destroyed. FIG. 4 shows an embodiment in which no special means is required in order to guarantee this. Instead, the combustion gases and the flames which occur during deflagration of the main explosive charge 101 in the rear housing part 209 cause the complete destruction of the control electronics system 201. During the deflagration there is a rapid increase in pressure and heat inside the housing 209, 211 of the missile 205, as a result of which a high excess pressure is created. Because the connection part 203 is configured as a predetermined breaking point between the two housing parts 209 and 211, this connection part 203 breaks during the deflagration, and the front housing part 209 is turned away or blasted away from the rear housing part 211, as is indicated in FIG. 4*c*). This produces a large opening at the end of the rear housing part 211 which points to the control electronics system 201. In this way, the rear housing part 211 becomes a tubular guidance device for the combustion gases and flames which occur during the deflagration. These combustion gases and flames are channeled forwards to the control electronics system 201 and destroy it completely. The embodiment with the predetermined breaking point 203 prevents the unwanted scenario whereby the rapid increase in pressure and heat rip open an opening in the housing 209, 211 at an unforeseeable point and the excess pressure is reduced through this opening without the control electronics system 201 having been completely destroyed,

LIST OF REFERENCE NUMBERS

101 Main explosive charge, is caused either to detonate by the detonation ignition chain 109 or to deflagrate by the deflagration ignition chain 119

103 Stage-2 ignition amplifier charge of the detonation ignition chain 09

105 Stage-1 ignition amplifier charge of the detonation ignition chain 109

107 Ignition initiator charge (detonator) of the detonation ignition chain 109

109 Detonation ignition chain, comprises the ignition initiator charge 107, the stage-1 ignition amplifier charge 105, and the stage-2 ignition amplifier charge 103

111 Ignition electronics system, in one embodiment selectively triggers either the detonation ignition chain 109 or the deflagration ignition chain 119 and in another embodiment the ignition means 213

117 Ignition initiator charge (deflagrator) of the deflagration ignition chain 119

119 Deflagration ignition chain, comprises the ignition initiator charge 117 and the deflagration charge 121

121 Deflagration charge of the deflagration ignition chain 119

123 Mechanical barrier between the detonation ignition chain 109 and the deflagration ignition chain 119

201 Control electronics system of the missile 205, arranged between the main explosive charge 101 and the front housing part 211, comprises the igniter electronic system 111, is destroyed during the detonation and deflagration of the main explosive charge 101

203 Mechanical connection part between the rear housing part 209 and the front housing part 211, configured as a predetermined breaking point

205 Missile (rocket), comprises the two housing parts 209 and 211, the main explosive charge 101, the detonation ignition chain 109, the deflagration ignition chain 119, and the control electronics system 201

207 Ignition initiator charge, belongs either to the detonation ignition chain or the deflagration ignition chain, depending on position

209 Rear housing part of the missile 205, includes the main explosive charge 101, the detonation ignition chain 109, the deflagration ignition chain 119, and the control electronics system 201

211 Front housing part of the missile 205, connected to the rear housing part in the connection part 203

213 Rotatably mounted ignition means, acts as a detonation ignition means or deflagration ignition means, depending on the position D Rotational axis about which the ignition means 213 can be turned

What is claimed is:

1. A weapon comprising:

an explosive charge;

a detonation ignition means that is activatable;

an ignition device configured to activate the detonation ignition means upon receipt of a detonation activation command, wherein the detonation ignition means is configured upon activation to cause the explosive charge to detonate;

a deflagration ignition means that is activatable, wherein the deflagration ignition means is configured upon activation to cause the explosive charge to deflagrate;

an electronic device and a guidance device, wherein the guidance device is configured to guide combustion gases and/or flames that occur during deflagration of the explosive charge in a direction of the electronic device whereby the electronic device is destroyed by the combustion gases and/or flames such that unauthorized persons who come into possession of the remnants of the deflagrated weapon are prevented from obtaining confidential information by inspecting or evaluating the electronic device, wherein the ignition device is configured to selectively activate the detonation ignition means or the deflagration ignition means; and a housing having a first housing part, a second housing part, and a predetermined breaking point, wherein the predetermined breaking point is configured such that deflagration of the explosive charge causes breakage of the predetermined breaking point, wherein following breakage of the predetermined breaking point the first housing part is movable relative to the second housing part, wherein the second housing part is configured such that following movement of the first housing part relative to the second housing part the second housing part acts as a component of the guidance device.

2. The weapon of claim 1 wherein the deflagration ignition means is spaced apart from the detonation ignition means.

3. The weapon of claim 1 comprising a mechanical barrier between the deflagration ignition means and the detonation ignition means, wherein the mechanical barrier is positioned to reduce a risk of the detonation ignition means being activated following activation of the deflagration ignition means.

4. The weapon of claim 1 wherein an activatable common component belongs to both the detonation ignition means and to the deflagration ignition means.

5. The weapon of claim 4 wherein the activatable common component is configured to be operated selectively in a detonation mode or in a deflagration mode, wherein the activatable common component is configured to contribute to detonation of the explosive charge in the detonation mode and configured to contribute to deflagration of the explosive charge in the deflagration mode.

6. The weapon of claim 4 wherein the activatable common component is selectively movable into a detonation position or into a deflagration position, wherein the activatable common component is configured to contribute to detonation of the explosive charge in the detonation position and configured to contribute to deflagration of the explosive charge in the deflagration position.

7. The weapon of claim 4 wherein the activatable common component is a first activatable common component, the weapon comprising a second activatable component that belongs to the detonation ignition means and not the deflagration ignition means, wherein the weapon is configured such that upon activation of the first activatable common component and the second activatable component, the explosive charge detonates, and upon activation of only the first activatable common component and not the second activatable component, the explosive charge deflagrates.

8. The weapon of claim 7 wherein the ignition device is configured to selectively activate the second activatable component and the first activatable common component according to a predefined temporal flow chart and thereby cause the explosive charge to detonate, or activate only the first activatable common component and thereby cause the explosive charge to deflagrate.

9. The weapon of claim 1 wherein the deflagration ignition means is configured as an ignition chain and comprises an ignition initiator charge and a deflagration charge.

10. The weapon of claim 1 configured for underwater deployment.

11. The weapon of claim 1 wherein the electronic device comprises a data store.

12. A method for operating a weapon wherein the weapon comprises a housing having a first housing part, a second housing part, and a predetermined breaking point, an explosive charge, a detonation ignition means that is activatable, an electronic device, a guidance device, and an ignition device configured to activate the detonation ignition means upon receipt of a detonation activation command, wherein the detonation ignition means is configured upon activation to cause the explosive charge to detonate, a deflagration ignition means that is activatable, the method comprising:

activating the deflagration ignition means with the ignition device upon an occurrence of a predetermined event without the explosive charge having been caused to detonate; and causing the explosive charge to deflagrate via the deflagration ignition means upon the activation of the deflagration ignition means, wherein the guidance guides combustion gases and/or flames that occur during deflagration of the explosive charge in a direction of the electronic device whereby the electronic device is destroyed by the combustion gases and/or flames such that unauthorized persons who come into possession of the remnants of the deflagrated weapon are prevented from obtaining confidential information by inspecting or evaluating the electronic device;

wherein deflagration of the explosive charge causes breakage of the predetermined breaking point, wherein following breakage of the predetermined breaking point the first housing part is movable relative to the second housing part, wherein the second housing part is configured such that following movement of the first housing part relative to the second housing part the second housing part acts as a component of the guidance device.

13. The method of claim 12 comprising dropping or abandoning the weapon, wherein the predetermined event occurs after a predetermined interval of time has elapsed after the dropping or the abandoning of the weapon, wherein the ignition device automatically activates the deflagration ignition means after the predetermined interval of time has elapsed.

14. The method of claim 12 wherein the ignition device activates the deflagration ignition means upon receipt of a deflagration activation command.

15. The method of claim 12 wherein the electronic device comprises a data store and wherein the data store is prevented from being read subsequent to being destroyed.

* * * * *